US005565289A

United States Patent [19]

Yoshihara et al.

[11] Patent Number: 5,565,289

[45] Date of Patent: Oct. 15, 1996

[54] ELECTROPHOTOGRAPHIC PHOTOSENSITIVE MEMBER, AND PROCESS CARTRIDGE AND ELECTROPHOTOGRAPHIC APPARATUS EMPLOYING THE SAME

[75] Inventors: Toshiyuki Yoshihara, Kawasaki; Hideki Anayama, Yokohama; Itaru Yamazaki, Yokohama; Hideyuki Ainoya, Yokohama; Hidetoshi Hirano, Tokyo, all of Japan

[73] Assignee: Canon Kabushiki Kaisha, Tokyo, Japan

[21] Appl. No.: 396,752

[22] Filed: Mar. 1, 1995

[30] Foreign Application Priority Data

Mar. 2, 1994 [JP] Japan ..... 6-032270

[51] Int. Cl.[6] ..... G03G 5/14

[52] U.S. Cl. ..... 430/64; 430/56; 430/65; 355/211

[58] Field of Search ..... 430/56, 64, 65; 355/211

[56] References Cited

U.S. PATENT DOCUMENTS 5,008,167 4/1991 Yu ..... 430/56
5,079,117 1/1992 Koyama et al. ..... 430/58
5,362,588 11/1994 Yoshihara et al. ..... 430/69

FOREIGN PATENT DOCUMENTS 0342798 11/1989 European Pat. Off. ..... G03G 15/00
0458273 11/1991 European Pat. Off. ..... G03G 15/00
7401760 8/1974 Netherlands ..... 430/56

OTHER PUBLICATIONS

Patent Abstracts of Japan, Pub. No. 06–1 30680, dated May 13, 1994.
Patent Abstracts of Japan, vol. 17, No. 293 (P–1550) [5922] Jun. 1993.
Patent Abstracts of Japan, vol. 15, No. 20& (P–1207) [4735] May 1991.

*Primary Examiner*—Roland Martin
*Attorney, Agent, or Firm*—Fitzpatrick, Cella, Harper & Scinto

[57] ABSTRACT

An electrophotographic photosensitive member is disclosed which has an electroconductive support and a photosensitive layer formed thereon. The photosensitive member is electrified by applying voltage to an electrification means brought into contact therewith, and it has higher impedance (Ω•cm) at an end portion than at other portion of the area where the photosensitive member is allowed to contact with the electrification means. Also, a process cartridge and an electrophotographic apparatus using the photosensitive member are disclosed.

21 Claims, 3 Drawing Sheets

ELECTROPHOTOGRAPHIC PHOTOSENSITIVE MEMBER, AND PROCESS CARTRIDGE AND ELECTROPHOTOGRAPHIC APPARATUS EMPLOYING THE SAME

BACKGROUND OF THE INVENTION

1. Field of the Invention

The present invention relates to an electrophotographic photosensitive member, more specifically to an electrophotographic photosensitive member having a specific layer constitution for direct electrification. The present invention also relates to a process cartridge and an electrophotographic apparatus employing the above electrophotographic photosensitive member.

2. Relating Background Art

The electrophotographic photosensitive member having a layer composed mainly of a resin or a resin layer containing a photoconductive substance has advantages of especially high productivity, relative inexpensiveness, and characteristics controllable by selection of the employed photoconductive substance. Accordingly, this type of photosensitive member is widely used practically.

The electrification means employed generally for the electrophotographic apparatus utilizes corona discharge caused by application of a high voltage to a wire. In recent years, direct electrification means are practically used which electrify a photosensitive member by applying voltage to a roller-shaped or plate-shaped electrification means brought into contact with it, because this type of electrification means requires lower voltage application and evolves less ozone. For uniform electrification with this direct electrification means, application of pulse voltage derived by superposition of DC voltage and AC voltage has been proposed.

The direct electrification means, however, has a disadvantage that the photosensitive member tends to be abraded by friction during repeated use, particularly at the end portion of the contacting zone of the electrification means on the photosensitive member rather than the middle portion thereof. This tendency is more pronounced when DC-AC superposed pulse voltage is applied, or when the voltage between the applied voltage peaks is raised or the pulse frequency is increased to accelerate the processing speed of the electrophotographic apparatus.

The resin-containing layer of the electrophotographic photosensitive member is usually formed by dip coating. The dip-coated layer is liable to be thinner at the top end portion in the dip coating than that at the middle and the bottom portions. The electrophotographic photosensitive member thus formed is liable to be abraded more at the thinner layer portion.

In the abraded thinned portion of the layer of the photosensitive member on a support, the surface potential becomes lower, causing lower image density in normal image development or fogging in reversal image development. The greater abrasion will give rise to dielectric breakdown to cause strip-like defects of the formed image.

The present invention was accomplished based on the consideration by the inventors of the present invention that the above phenomenon is ascribable to the joule heat of the electric current through the photosensitive member on application of voltage. According to the consideration, when the electrification member is brought into contact with the photosensitive member, the contact pressure tends to be higher at the end portion of the electrification member than the middle portion thereof, which enlarges the contacting areal size at the end portion of the contacting zone to allow larger electric current to flow, thereby causing more abrasion. The AC current flows more readily than the DC current, tending to cause abrasion. The higher voltage between the voltage peaks causes larger electric current to give abrasion. A higher frequency reduces impedance of the circuit to cause a larger current to flow to give abrasion. A smaller thickness of the layer reduces the impedance to intensify the current to give abrasion.

SUMMARY OF THE INVENTION

The present invention intends to provide an electrophotographic photosensitive member which gives excellent images without abrasion of the end portion thereof in direct electrification of the photosensitive member.

The present invention also intends to provide a process cartridge and an electrophotographic apparatus employing the above electrophotographic photosensitive member.

The electrophotographic photosensitive member of the present invention comprises an electroconductive support, and a photosensitive layer formed thereon, the electrophotographic photosensitive member being electrified by applying voltage to an electrification means brought into contact therewith, wherein the photosensitive member has higher impedance (Ω•cm) at an end portion than at other portion of the area where the photosensitive member is allowed to contact with the electrification means.

The process cartridge, and the electrophotographic apparatus of the present invention employ the aforementioned electrophotographic photosensitive member.

DESCRIPTION OF THE PREFERRED EMBODIMENTS

The electrophotographic photosensitive member of the present invention is electrified by bringing into contact an electrification member therewith and applying voltage to the electrification member.

The electrophotographic photosensitive member of the present invention comprises an electroconductive support, and a photosensitive layer formed thereon. The electrophotographic photosensitive member is electrified by applying voltage to an electrification means brought into contact therewith, wherein the photosensitive member has higher impedance (Ω•cm) at an end portion than at other portion of the area where the photosensitive member is allowed to contact with the electrification means.

The electrophotographic photosensitive member of the present invention preferably has an interlayer having higher impedance at the end portion thereof. More specifically, the electrophotographic photosensitive member preferably comprises one or more interlayers of high impedance between the photosensitive layer and the electroconductive support at an end portion of the contacting zone where the electrification member is allowed to contact with the electrophotographic photosensitive member, and at least one of the interlayers preferably being not provided at the portion other than the end portion.

Figure 1:
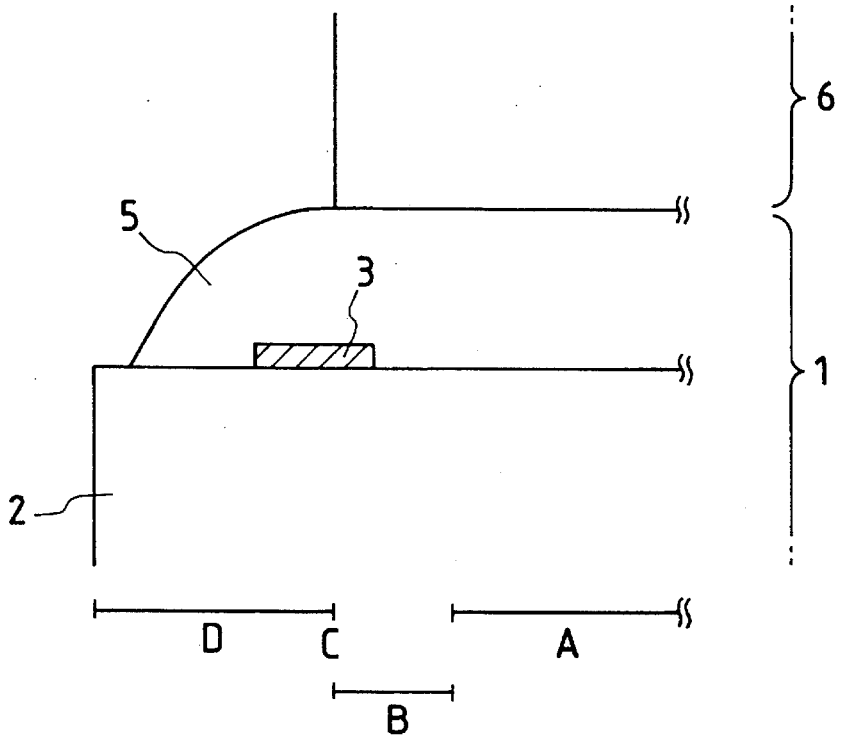
FIG. 1 illustrates an example of the layer constitution of the electrophotographic photosensitive member of the present invention.
Figure 2:
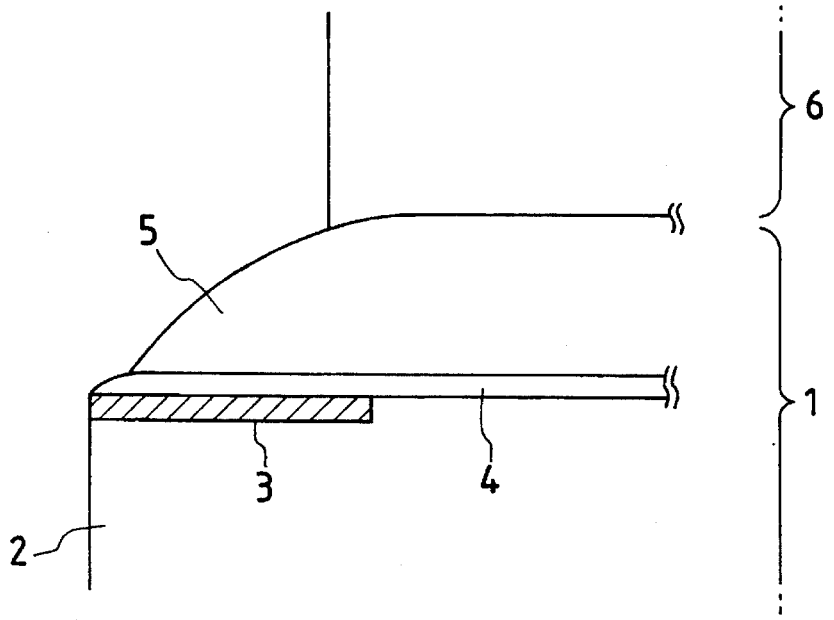
FIG. 2 illustrates another example of the layer constitution of the electrophotographic photosensitive member of the present invention.

In an example of the electrophotographic photosensitive member of the present invention, one interlayer is provided at the end portion of the member, and no interlayer is provided at the middle portion thereof as illustrated in FIG. 1. In another example, two interlayers are provided at the end portion, and one interlayer is provided as illustrated in FIG. 2 or no interlayer is provided (not shown in the drawing) at the middle portion of the member. In FIG. 1 and FIG. 2, the electrophotographic photosensitive member 1 comprises an electroconductive support 2, interlayers 3, 4, a photosensitive layer 5, and an electrification member 6. The interlayer 3 has high impedance, whereas the interlayer 4 preferably has high impedance in view of prevention of friction abrasion, but it is not essential since high impedance is disadvantageous from the viewpoint of sensitivity and residual potential of the photosensitive member. Accordingly, the electrophotographic photosensitive member of the present invention does preferably not have high impedance except for the end portion.

With the above construction of the electrophotographic photosensitive member of the present invention, flow of the electric current is impeded at the end portion of the member, thereby the abrasion of the photosensitive member being retarded there, or if abraded, remarkable drop of the surface potential and occurrence of dielectric breakdown being retarded since the total thickness is larger by the thickness of the interlayer.

The "high impedance" in the present invention is preferably not lower than $10^{15}$ Ω•cm, more preferably not lower than $10^{16}$ Ω•cm.

The impedance is measured in the present invention as described follows. On an aluminum plate, a layer is formed which has the same constitution as the one of the photosensitive member. On the surface of the layer an electrode is formed by vapor deposition of gold. AC voltage (voltage between peaks: 2 kV, frequency: 800 Hz) is applied between the electrode and the aluminum plate, and the effective value of the resulting electric current flowing through the aluminum plate is measured to obtain the impedance.

The high-impedance interlayer in the present invention has preferably a thickness ranging from 1 to 100 μm, more preferably from 2 to 30 μm.

In consideration of the liability of exhaustion of the photosensitive layer by severe abrasion, the high-impedance interlayer of the present invention has preferably a high hardness, specifically a pencil hardness of 4H or higher.

The material for the aforementioned interlayer may be selected from a variety of resins. In view of the impedance, the material has preferably a low dielectric constant, and in view of the hardness, the material has preferably a crosslinked structure. Specific example includes phenol resins, polyester resins, and epoxy resins. This interlayer may contain a filler such as glass fiber.

Figure 3:
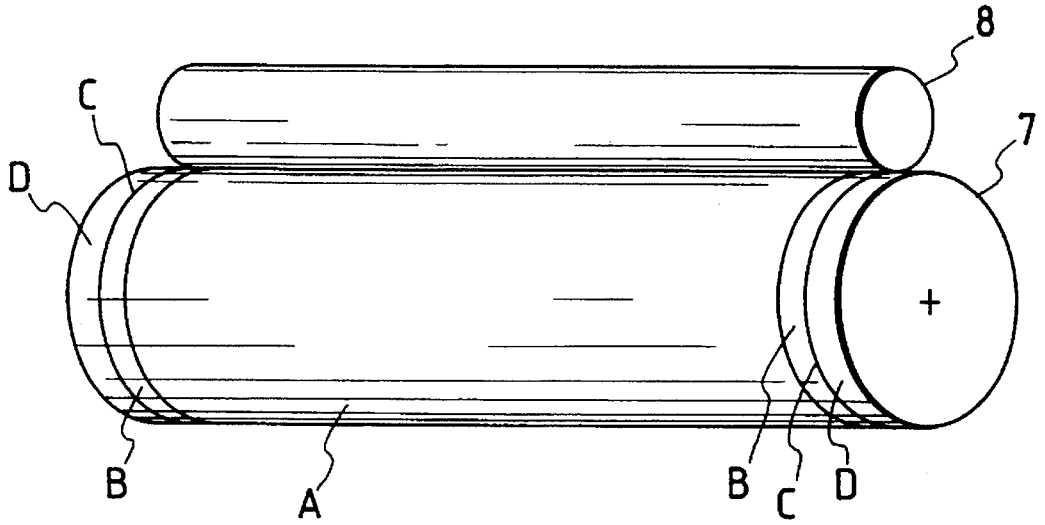
FIG. 3 shows relative positional relation of the electrification member with the electrophotographic photosensitive member of the present invention.

The aforementioned contacting zone of the photosensitive member coming into contact with the electrification member is explained by reference to FIG. 1 and FIG. 3. The contacting zone signifies the entire area where the photosensitive member 1,7 is brought into contact with the electrification member 6,8, and includes the regions A and B. The end portion of that area signifies the contacting zone excluding the image formation region A, namely the region B. The electrophotographic photosensitive member of the present invention has higher impedance at the end portion. Preferably, it has higher impedance at an area in the end portion of 3 mm, more preferably 5 mm in width inside from the end C of the contacting zone. In the region D outside the contacting zone, however, the impedance of the electrophotographic photosensitive member is not specially limited.

The photosensitive layer of the electrophotographic photosensitive member of the present invention is classified into two types: a single layer type one and a lamination type one. The single layer type one contains both a charge-generating substance and a charge-transporting substance in one and the same layer. The lamination type one comprises separately a charge-generating layer containing a charge-generating substance, and a charge-transporting layer containing a charge-transporting substance. The lamination type one is further subdivided into two types: a first type one which has an electroconductive support, a charge-generating layer, and a charge-transporting layer in the named order, and a second type one which has an electroconductive support, a charge-transporting layer, and a charge-generating layer in the named order. In the present invention, the lamination type layer is preferred, particularly the one having the charge-transporting layer laminated on the charge-generating layer.

The charge-generating layer may be formed by vacuum vapor deposition of a charge-generating substance on an electroconductive support, or applying and drying a dispersion or a solution of a charge-generating substance and a binder resin in a suitable solvent. The thickness of the charge-generating layer is preferably not more than 5 μm, more preferably in the range of from 0.1 to 1 μm.

The charge-generating substance includes azo pigments such as monoazo pigments, bisazo pigments, and trisazo pigments; phthalocyanine pigments such as metallophthalocyanines and non-metal phthalocyanines; indigo pigments such as indigo and thioindigo; polycyclic quinone pigments such as anthoanthorone and pyrene-quinone; perylene pigments such as perylenic anhydride and perylenimide; squarilium dyes; pyrylium and thiapyrylium salts; triphenylmethane dyes; and the like.

The aforementioned binder resin for the charge-generating layer is selected from a varieties of insulative resins and organic photoconductive polymers. Suitable binder resins include polyvinylbutyral, polyvinylbenzal, polyarylate, polycarbonates, polyesters, phenoxy resins, cellulose resins, acrylic resins, and polyurethanes. These resins may have a substituent. Preferred substituent includes halogen atoms, alkyl groups, alkoxy groups, nitro group, trifluoromethyl group, and cyano group. The content of the binder resin is preferably not higher than 80% by weight, more preferably not higher than 40% by weight based on the total weight of the charge-generating layer.

The aforementioned solvent is selected preferably from the solvents which is capable of dissolving the above resins but is incapable of dissolving the charge-transporting layer or the interlayer mentioned later. The suitable solvents include ethers such as tetrahydrofuran and 1,4-dioxane; ketones such as cyclohexanone and methyl ethyl ketone;

amides such as N,N-dimethylformamide; esters such as methyl acetate and ethyl acetate; aromatic hydrocarbons such as toluene, xylene, and monochlorobenzene; alcohols such as methanol, ethanol, and 2-propanol; and aliphatic hydrocarbons such as chloroform and methylene chloride.

The charge-transporting layer may be laminated as an overlying layer or an underlying layer of the charge-generating layer, and serves to receive charge carriers and transport them under an electric field. The charge-transporting layer may be formed by coating and drying of a solution of a charge-transporting substance and an optional binder resin in a solvent. The thickness thereof is preferably in the range of from 5 to 40 μm, more preferably from 15 to 30 μm.

The charge-transporting substances are classified into electron-transporting substances and positive hole-transporting substances. The electron-transporting substances include electron-attracting substances such as 2,4,7-trinitrofluorenone, 2,4,5,7-tetranitrofluorenone, chloranil, tetracyanoquinodimethane, and the like, and polymerized products of such electron-attracting substances. The positive hole-transporting substances include polycyclic aromatic compounds such as pyrene and anthrathene; heterocyclic compounds such as carbazole, indole, imidazole, oxazole, thiazole, oxadiazole, pyrazole, pyrazoline, thiadiazole, and triazole; hydrazone type compounds such as p-diethylaminobenzaldehyde-N,N-diphenylhydrazone, and N,N-diphenylhydrazino-3 -methylidene-9-ethylcarbazole; styryl type compounds such as α-phenyl-4'-N,N-diphenylaminostilbene, and 5-[4-(di-p-tolylamino)benzylidene]-5H-dibenzo [a,d]-cycloheptene; benzidine type compounds; triarylmethane type compounds; triphenylmethane type compounds; and polymers having a group derived from the above compounds as the main chain or the side chain (e.g., poly-N-vinylcarbazole, polyvinylanthrathene, etc.). The charge-transporting substances include also inorganic materials such as selenium, seleniumtellurium, amorphous silicon, cadmium sulfide, and the like. The charge-transporting substance may be employed singly or in combination of two or more thereof.

If the charge-transporting substance does not have a film-forming property, a suitable binder may be used. Specifically, the binder includes insulative resins such as acrylic resins, polyarylates, polyesters, polycarbonates, polystyrenes, acrylonitrile-styrene copolymers, polyacrylamides, polyamides, and chlorinated rubbers; and organic photoconductive polymers such as poly-N-vinylcarbozole and polyvinylanthrathene. The content of the binder is preferably in the range of from 20 to 90% by weight, more preferably from 40 to 70% by weight based on the total weight of the charge-transporting layer.

Another embodiment of the present invention is an electrophotographic photosensitive member having a photosensitive layer containing both a charge-generating substance and the aforementioned charge-transporting substance in one and the same layer. As the charge-transporting substance, a charge transfer complex composed of poly-N-vinylcarbazole and trinitrofluorenone may be used. This type of electrophotographic photosensitive member may be produced by applying and drying a solution or dispersion containing a charge-generating substance, a charge-transporting substance, and a suitable binder on an electroconductive support. The binder resin is contained preferably at a content ranging from 20 to 90%, more preferably 40 to 70% by weight based on the total weight of the photosensitive layer. The photosensitive layer has preferably a thickness of 5 to 40 μm, more preferably from 15 to 30 μm.

In any type of the electrophotographic photosensitive member, the charge-generating substance may be a single substance or combination of two or more of charge-generating substances.

The electroconductive support in the present invention is made of a material such as aluminum, aluminum alloys, copper, zinc, stainless steel, vanadium, molybdenum, chromium, titanium, nickel, indium, gold, and platinum. The support may be made of a plastic material having a film of the aforementioned metal of alloy formed thereon by vacuum vapor deposition, the plastic film including polyethylene, polypropylene, polyvinyl chloride, polyethylene terephthalate, acrylic resins, etc. The support may also be made of a plastic, a metal, or an alloy coated with an electroconductive particulate material such as carbon black and particulate silver with a suitable binder resin applied thereon. Further the support may be made of a plastic sheet or a paper sheet impregnated with an electroconductive particulate material. The support may be in a shape of a drum, a sheet, or a belt, and is preferably in a shape suitable for the electrophotographic apparatus that employs the electrophotographic photosensitive member.

A second interlayer 4 may be provided for a barrier function and an adhesion function between the electroconductive support and the photosensitive layer in addition to the high-impedance interlayer in the present invention. The second interlayer has preferably a thickness of not more than 5 μm, more preferably in the range of from 0.1 to 3 μm. The second interlayer may be made of a material such as casein, polyvinyl alcohol, nitrocellulose, polyamides (nylon 6, nylon 66, nylon 610, copolymer nylon, alkoxymethylated nylon, etc.), polyurethanes, and aluminum oxide.

A protecting layer may further be provided on the aforementioned photosensitive layer in the present invention for protecting the photosensitive layer against adverse external mechanical and chemical effects. The protecting layer may be a simple resin layer or a resin layer containing electroconductive particulate material or a charge-transporting substance. This protecting layer is defined as a constituent of the photosensitive layer of the present invention.

The electrification member employed in the present invention may be any known electrification member for direct electrification. The shape thereof may be a roller as shown in FIG. 3, or a blade, a belt, or the like. The electrification member in a roller shape or a blade shape may be prepared by molding, on an electroconductive core material such as a metal or an alloy, an electroconductive resin or a resin treated for electroconductivity by dispersion of carbon black, a metal, or a metal oxide, or applying and drying such resin.

The electrophotographic photosensitive member of the present invention is useful for a variety of electrophotographic apparatuses such as electrophotographic copying machines, laser beam printers, CRT printers, LED printers, and liquid-crystal printers, and for apparatuses employing electrophotography techniques such as laser engraving apparatus, and facsimile machines.

Figure 4:
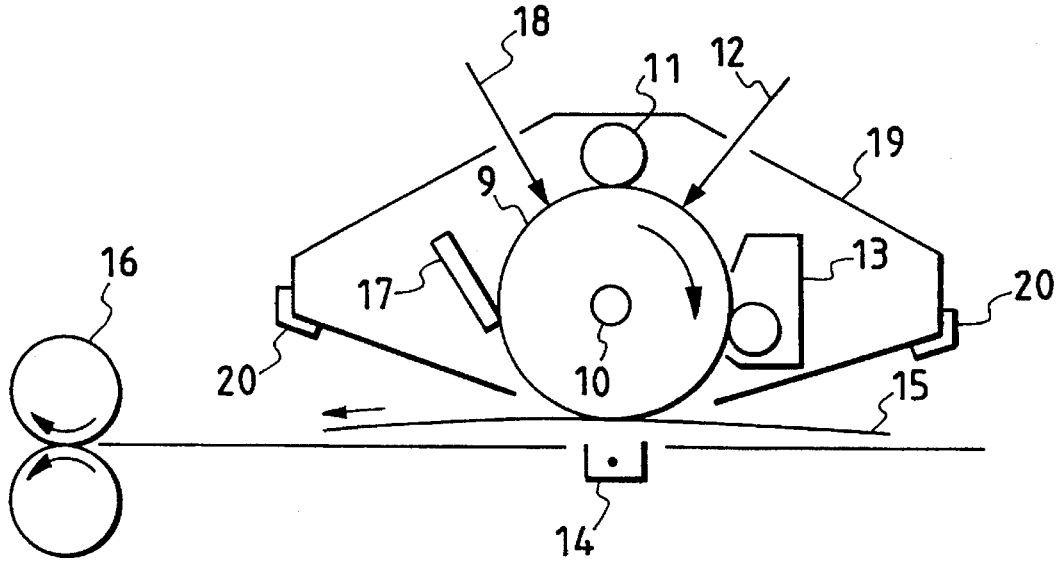
FIG. 4 shows schematically a constitution of an electrophotographic apparatus employing a process cartridge having an electrophotographic photosensitive member of the present invention.

FIG. 4 illustrates schematically an example of the constitution of an electrophotographic apparatus employing a process cartridge having an electrophotographic photosensitive member of the present invention.

In FIG. 4, a drum-shaped electrophotographic photosensitive member 9 of the present invention is driven to rotate around the axis 10 in the arrow direction at a prescribed peripheral speed. The photosensitive member 9 is electrified positively or negatively at the peripheral face uniformly during the rotation by an electrostatic electrification means 11, and then exposed to image-exposure light 12 (e.g., slit exposure, laser beam-scanning exposure, etc.) with an image-exposure means (not shown in the drawing), whereby an electrostatic latent image is successively formed on the peripheral surface of the photosensitive member 9.

The formed electrostatic latent image is then developed with a toner by a developing means 13. The developed toner image is successively transferred by a transfer means 14 onto a surface of a transfer-receiving material 15 which is fed between the photosensitive member 9 and the transfer means 14 synchronously with the rotation of the photosensitive member 9 from a transfer-receiving material feeder not shown in the drawing.

The transfer receiving material 15 which has received the transferred image is separated from the photosensitive member surface, and introduced to an image fixing means 16 for fixation of the image and sent out of the copying machine as a duplicate copy.

The surface of the photosensitive member 9, after the image transfer, is cleaned with a cleaning means 17 to remove any remaining un-transferred toner, and is treated for charge elimination by pre-exposure light 18 from a pre-exposure means (not shown in the drawing) for subsequent image formation. In the present invention, since the primary electrification is conducted by a direct electrification means 11 employing an electrification roller or the like, the pre-exposure is not essential.

In the present invention, two or more of the aforementioned constituting elements including the electrophotographic photosensitive member 9, the primary electrification means 11, the developing means 13, the cleaning means 17, and so forth of the electrophotographic apparatus may be integrated as a process cartridge so as to be demountable from the main body of the electrophotographic apparatus such as a copying machine or a laser beam printer. For example, at least one of the primary electrification means 11, the developing means 13, and the cleaning means 17 is integrated with the photosensitive member 9 into a cartridge 19 which is demountable from the main body of the apparatus by aid of a guide means such as a rail 20 in the main body of the apparatus.

When the electrophotographic apparatus is employed in a copying machine or a printer, the image exposure light 12 is projected onto the photosensitive member as reflected light or transmitted light from an original, or the information read out by a sensor from an original is signalized, and light is projected, onto a photosensitive member, by scanning with a laser beam, driving an LED array, driving a liquid crystal shutter array, or the like means in accordance with the signal.

Figure 5:
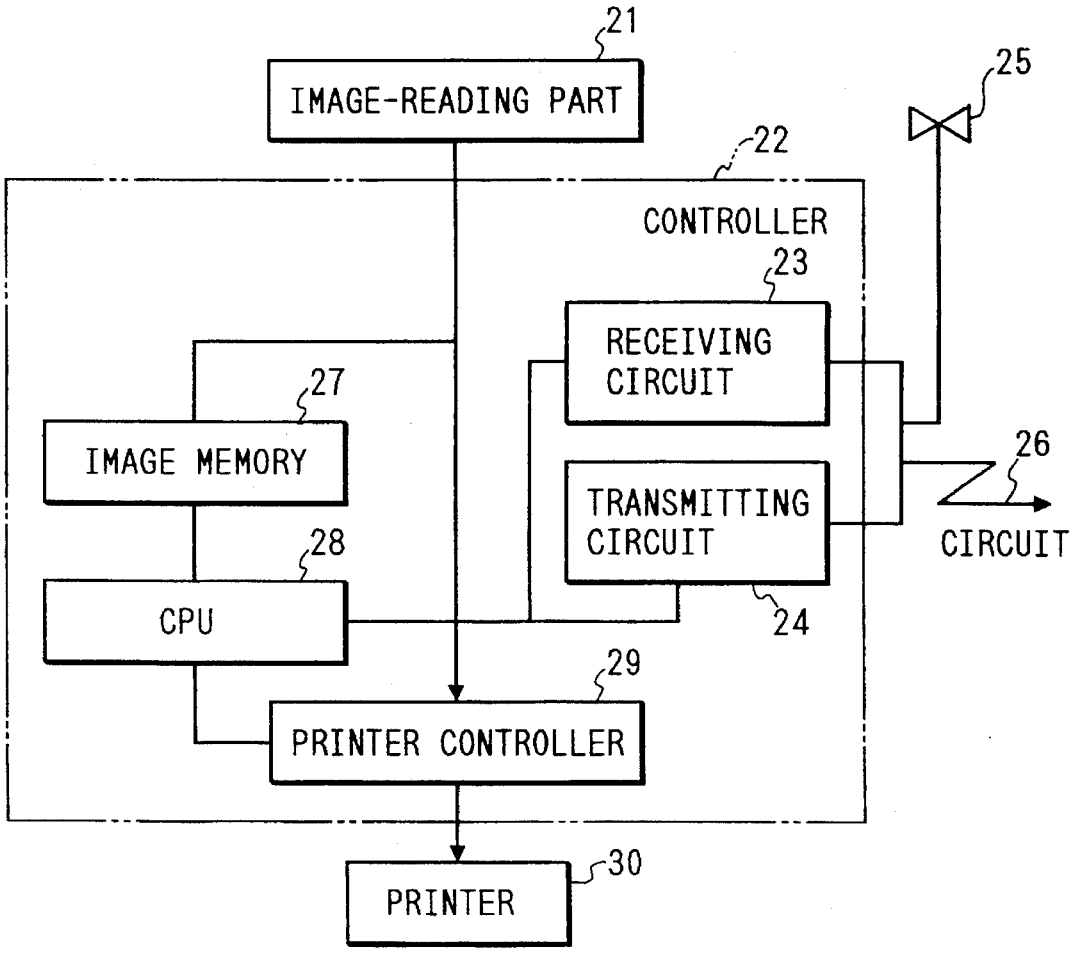
FIG. 5 shows an example of a block diagram of a facsimile system employing an electrophotographic photosensitive member of the present invention.

When the electrophotographic apparatus is used as a printer of a facsimile machine, the optical image exposure light 12 is employed for printing the received data. FIG. 5 is a block diagram of an example of this case.

A controller 22 controls the image-reading part 21 and a printer 30. The entire of the controller 22 is controlled by a CPU 28. Readout data from the image reading part 21 is transmitted through a transmitting circuit 24 to the other communication station. Data received from the other communication station is transmitted through a receiving circuit 23 to the printer 30. The image data is stored in an image memory 27. A printer controller 29 controls the printer 30. The numeral 25 denotes a telephone set.

The image received through a circuit 26 (namely, image information from a remote terminal connected through the circuit) is demodulated by the receiving circuit 23, treated for decoding of the image information in the CPU 28, and successively stored in the image memory 27. When at least one page of image information has been store in the image memory 27, the images are recorded in such a manner that the CPU 28 reads out one page of the image information from the image memory 27, and sends out the one page of the decoded information to the printer controller 29, which controls the printer 30 on receiving the one page of the information from the CPU 28 to record the image information. During recording by the printer 30, the CPU 28 receives the subsequent page of information.

Images are received and recorded in the manner as described above.

The present invention is described below in more detail by reference to examples.

EXAMPLE 1

On 20-mm regions of the both ends of an aluminum cylinder of 30 mm in outside diameter and 260 mm in length, an interlayer of 2 μm thick were formed by applying and curing a thermosetting phenol resin. This interlayer had impedance of $10^{16}$ Ω•cm according to the above described measurement method.

In 100 g of cyclohexanone, was dissolved 3 g of polyvinylbutyral (butyralation degree of 63% or higher, number-average polymerization degree of 2,000). Thereto, 6 g of the azo pigments A and B (ratio A/B=1:2) was added, and was allowed to disperse therein by mean of a sand mill for 48 hours.

(A)

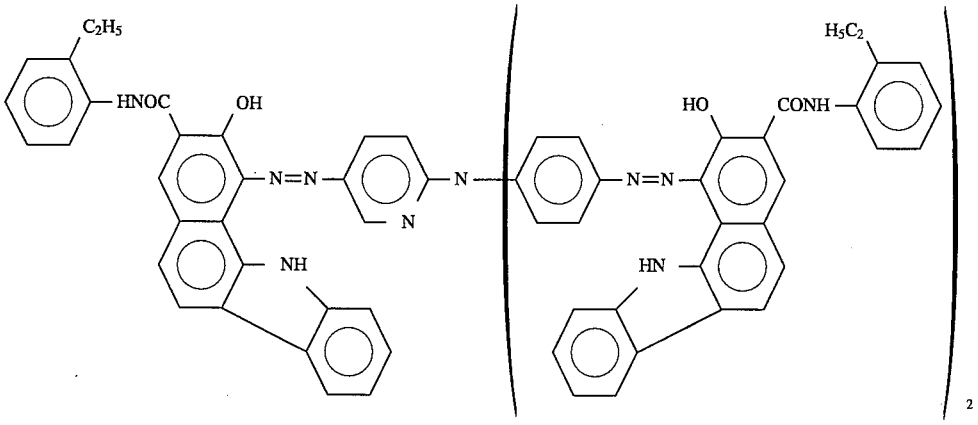

-continued

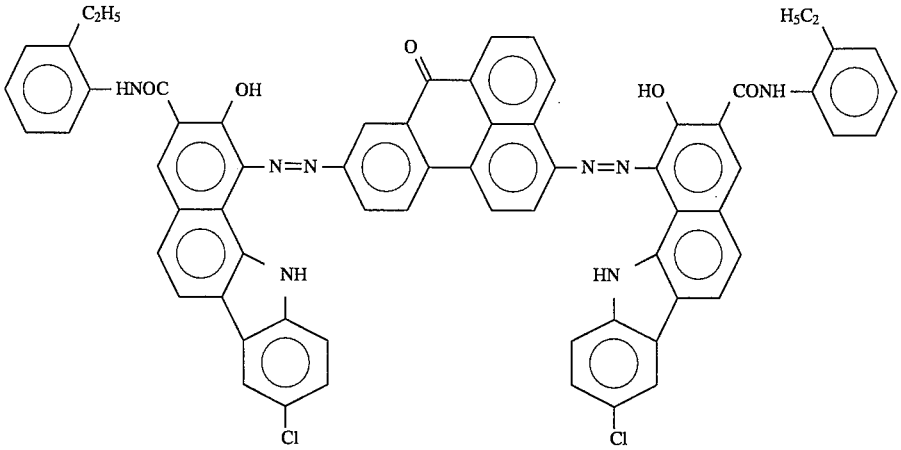

(B)

This dispersion was applied onto the above cylinder by dip coating and dried to form a charge-generating layer of 0.2 μm thick.

Then, 8 g of the compound represented by the chemical formula below and 10 g of bisphenol Z type polycarbonate (viscosity-average molecular weight: 22,000) were dissolved in a mixture of 40 g of chlorobenzene and 10 g of dichloromethane.

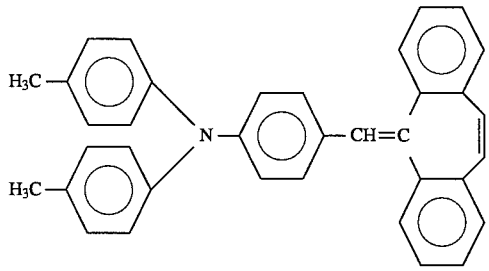

This solution was applied by dip coating on the above charge-generating layer and dried to form a charge-transporting layer of 25 μm thick.

Separately, an electrification member was prepared by forming, on the peripheral face of a stainless steel shaft of 6 mm in diameter, a layer of chloroprene rubber containing electroconductive carbon dispersed therein and having electric resistance of $10^7$ Ω was formed such that the outside diameter was 12 mm and the length of the rubber part was 230 mm. Thereby, the ends of the roller of the electrification member was at the position of 15 mm inside from the both ends of the photosensitive member.

The obtained electrophotographic photosensitive member and the electrification member were set in a process cartridge of a laser beam printer (LBP-NX, manufactured by Canon K.K.), and subjected to endurance test. With this apparatus, the electrification conditions were as follows. Applied voltage: superposition of DC voltage ($V_{DC}$) with AC voltage ($V_{AC}$); $V_{DC}$: −700 V, $V_{AC}$ between peaks ($V_{P_P}$): 2000 V, and frequency of $V_{AC}$: 650 Hz. The printing speed was 16 sheets per minute, and the process speed was 94 mm per second.

The endurance test was conducted by repeating solid white image printing 12000 times at ordinary temperature and humidity (23° C., 55%), and at high temperature and high humidity (32.5° C., 85%). In the test, occurrence of image defect (fogging) caused by abrasion by contact of the photosensitive member with the end portion of the electrification means was observed. The evaluation was made by visual observation and measurement of the fogging degree (ΔR). The reflectivity was measured by means of a Photovolt reflectometer with the 12000th image. ΔR was represented by the difference of the maximum reflectivity (%) of 12000th image from the reflectivity (%) of the transfer paper before the printing. If the value of ΔR of the image is higher than 2.5%, the image is not satisfactory in practical use.

The results are shown in Table 1.

COMPARATIVE EXAMPLE 1

An electrophotographic photosensitive member was prepared in the same manner as in Example 1 except that the interlayer was not provided. The results of the evaluation are shown in Table 1.

EXAMPLE 2

On the aluminum cylinder employed in Example 1, an electroconductive layer of 5 μm was formed, except for 20-mm regions at the both ends, by application of a paint composed of a thermosetting phenol resin and electroconductive tin oxide dispersed therein, and curing it. This interlayer had impedance of $10^9$ Ω•cm. On the 20-mm region of the both ends, an interlayer of 5 μm thick was formed by applying and curing the thermosetting phenol resin only. This second interlayer had impedance of $10^{16}$ Ω•cm.

On these interlayers, a charge-generating layer and a charge-transporting layer were formed in the same manner as in Example 1. The obtained electrophotographic photosensitive member was evaluated in the same manner as in Example 1.

The results are shown in Table 1.

EXAMPLE 3

Endurance test was conducted in the same manner as in Example 1 except that the frequency of $V_{AC}$ of the laser beam printer was changed to 920 Hz, the printing speed was changed to 20 sheet per minute, and the process speed was changed to 120 mm per second.

The results are shown in Table 1.

EXAMPLE 4

An interlayer was formed in the same manner as in Example 1 except that bisphenol A type epoxy resin and a tertiary amine were used in place of the phenol resin and the layer thickness was adjusted to be 5 μm. The impedance of this interlayer was $10^{15}$ Ω•cm.

A further interlayer was formed on the above cylinder by applying, by dip coating, a solution of 5 g of methoxymethylated nylon (number-average molecular weight: 32,000) and 10 g of alcohol-soluble copolymer nylon (number-average molecular weight: 29,000) in 95 g methanol, and drying it in a thickness of 1 μm. This interlayer had impedance of $10^{12}$ Ω•cm.

Further on this interlayer a charge-generating layer and a charge-transporting layer were formed in the same manner as in Example 1. The obtained electrophotographic photosensitive member was evaluated in the same manner as in Example 1.

The evaluation results are shown in Table 1.

TABLE 1

| | Ordinary temperature & ordinary humidity | | High temperature & high humidity | |
|---|---|---|---|---|
| | Image quality | ΔR (%) | Image quality | ΔR (%) |
| Example | | | | |
| 1 | Good | 0.5 | Good | 0.5 |
| 2 | Good | 0.4 | Good | 0.5 |
| 3 | Good | 0.5 | Good | 0.6 |
| 4 | Good | 0.5 | Good | 0.5 |
| Comparative example | | | | |
| 1 | Fogging at 8000th copy | 5.0 | Fogging at 3000th copy | 5.5 |

What is claimed is:

1. An electrophotographic photosensitive member comprising an electroconductive support, and a photosensitive layer formed thereon, the electrophotographic photosensitive member including a photosensitive member having a protecting layer on said photosensitive layer and being electrified by applying voltage to an electrification means brought into contact therewith, wherein the photosensitive member has higher impedance (Ω•cm) at an end portion including the photosensitive layer than at other portion of the area where the photosensitive member is allowed to contact with the electrification means, wherein said higher impedance does not result from material being in contact with the outer surface of said photosensitive layer.

2. The electrophotographic photosensitive member according to claim 1, wherein the electrophotographic photosensitive member comprises one or more interlayers of high impedance, between the photosensitive layer and the electroconductive support, at an end portion of the contacting zone where the electrification member is allowed to contact with the electrophotographic photosensitive member, and at least one of the interlayers being not provided at the portion except for the end portion.

3. The electrophotographic photosensitive member according to claim 1, wherein pulse voltage derived by superposition of DC voltage and AC voltage is applied to the electrification means.

4. The electrophotographic photosensitive member according to claim 2, wherein pulse voltage derived by superposition of DC voltage and AC voltage is applied to the electrification means.

5. The electrophotographic photosensitive member according to claim 2, wherein the interlayer has impedance of not lower than $10^{15}$ Ω•cm.

6. The electrophotographic photosensitive member according to claim 2, wherein the interlayer has a thickness ranging from 1 to 100 μm.

7. The electrophotographic photosensitive member according to claim 5, wherein the interlayer has a thickness ranging from 1 to 100 μm.

8. A process cartridge comprising an electrophotographic photosensitive member, a contact electrification means having an electrification member, and at least one means selected from the group of a developing means, and a cleaning means: said electrophotographic photosensitive member comprising an electroconductive support and a photosensitive layer formed thereon, the electrophotographic photosensitive member being electrified by applying voltage to an electrification means brought into contact therewith, wherein the photosensitive member has higher impedance (Ω•cm) at an end portion including the photosensitive layer than at other portion of the area where the photosensitive member is allowed to contact with the electrification means; and said electrophotographic photosensitive member and said at least one means being integrated into one body so as to be demountable from the main body of an electrophotographic apparatus.

9. The process cartridge according to claim 8, wherein the electrophotographic photosensitive member comprises one or more interlayers of high impedance, between the photosensitive layer and the electroconductive support, at an end portion of the contacting zone where the electrification member is allowed to contact with the electrophotographic photosensitive member, and at least one of the interlayers being not provided at the portion except for the end portion.

10. The process cartridge according to claim 8, wherein pulse voltage derived by superposition of DC voltage and AC voltage is applied to the electrification means.

11. The process cartridge according to claim 9, wherein pulse voltage derived by superposition of DC voltage and AC voltage is applied to the electrification means.

12. The process cartridge according to claim 9, wherein the interlayer has impedance of not lower than $10^{15}$ Ω•cm.

13. The process cartridge according to claim 9, wherein the interlayer has a thickness ranging from 1 to 100 μm.

14. The process cartridge according to claim 12, wherein the interlayer has a thickness ranging from 1 to 100 μm.

15. An electrophotographic apparatus comprising an electrophotographic photosensitive member having a photosensitive layer formed on an electroconductive support, an electrification means having an electrifying member in contact with the electrophotographic photosensitive member for electrifying the electrophotographic photosensitive member on application of voltage, an imagewise exposure means, a developing means, and an image transfer means, wherein the photosensitive member has higher impedance (Ω•cm) at an end portion including the photosensitive layer than at other portion of the area where the photosensitive member is allowed to contact with the electrification means.

16. The electrophotographic apparatus according to claim 15, wherein the electrophotographic photosensitive member comprises one or more insulative layers, between the photosensitive layer and the electroconductive support, at an end portion of the contacting zone where the electrification member is allowed to contact with the electrophotographic photosensitive member, and at least one of the insulative layers being not provided at the portion except for the end portion.

17. The electrophotographic apparatus according to claim 15, wherein pulse voltage derived by superposition of DC voltage and AC voltage is applied to the electrification means.

18. The electrophotographic apparatus according to claim 16, wherein pulse voltage derived by superposition of DC voltage and AC voltage is applied to the electrification means.

19. The electrophotographic apparatus according to claim 16, wherein the interlayer has impedance of not lower than $10^{15}$ Ω•cm.

20. The electrophotographic apparatus according to claim 16, wherein the interlayer has a thickness ranging from 1 to 100 μm.

21. The electrophotographic apparatus according to claim 19, wherein the interlayer has a thickness ranging from 1 to 100 m.

* * * * *